US009494391B1

(12) United States Patent
Broadbent

(10) Patent No.: US 9,494,391 B1
(45) Date of Patent: Nov. 15, 2016

(54) SHOOTING TARGET AND METHOD OF MAKING SAME

(71) Applicant: BlisterCell, LLC, Allison Park, PA (US)

(72) Inventor: Jay F. Broadbent, Allison Park, PA (US)

(73) Assignee: BlisterCell, LLC, Allison Park, PA (US)

( * ) Notice: Subject to any disclaimer, the term of this patent is extended or adjusted under 35 U.S.C. 154(b) by 0 days.

(21) Appl. No.: 14/694,777

(22) Filed: Apr. 23, 2015

(51) Int. Cl.
*F41J 5/24* (2006.01)
*F41J 1/01* (2006.01)
*F41J 5/22* (2006.01)

(52) U.S. Cl.
CPC ... *F41J 1/01* (2013.01); *F41J 5/22* (2013.01); *F41J 5/24* (2013.01)

(58) Field of Classification Search
CPC ..... F41J 5/20–5/26
USPC ..... 273/378–380, 383–389
See application file for complete search history.

(56) References Cited

U.S. PATENT DOCUMENTS 3,330,561 A 7/1967 Kandel
3,353,827 A 11/1967 Dun, Jr.
3,370,852 A 2/1968 Kandel
3,423,092 A 1/1969 Kandel
3,486,752 A 12/1969 Colvin et al.
3,895,803 A 7/1975 Loe
4,630,832 A 12/1986 Swanson
4,656,092 A 4/1987 Haman et al.
4,781,595 A * 11/1988 Cox ..... A63F 3/0685 434/328
4,921,256 A 5/1990 Gearhart
5,186,468 A 2/1993 Davies
5,188,371 A 2/1993 Edwards
5,308,084 A 5/1994 Morrell
5,501,467 A 3/1996 Kandel
5,503,403 A 4/1996 Morrell
5,580,063 A 12/1996 Edwards
6,966,557 B2 * 11/2005 Kirk ..... A63F 9/0243 273/349
7,631,877 B2 12/2009 Zara
8,444,056 B2 5/2013 Gamez et al.
8,596,643 B1 12/2013 Edwards
8,814,167 B2 * 8/2014 Davis, Jr. ..... F41J 5/24 273/378
8,814,168 B2 * 8/2014 Davis, Jr. ..... F41J 5/24 273/380
9,170,077 B2 * 10/2015 Johnson ..... F41J 5/24
2008/0277875 A1 * 11/2008 Mincenberg ..... F41J 1/01 273/378
2010/0116163 A1 5/2010 Zara
2011/0316234 A1 12/2011 Miller, Sr.
2013/0009364 A1 1/2013 Forness et al.
2013/0038020 A1 2/2013 Davis, Jr.
2013/0228974 A1 9/2013 Davis, Jr.
2013/0270773 A1 10/2013 Johnson et al.
2014/0175746 A1 * 6/2014 Fife ..... F41J 5/20 273/378

* cited by examiner

*Primary Examiner* — Mark Graham
(74) *Attorney, Agent, or Firm* — Howson & Howson LLP

(57) ABSTRACT

A multiple blister, dye-containing unit for attachment to the back face of a shooting target sheet is formed into a suitable shape corresponding to a predetermined portion of an image on the front face of the target sheet by removal of a portion of a larger array of blisters arranged in rows and columns. The multiple blister unit is than secured by adhesive to the back face of the target sheet.

3 Claims, 3 Drawing Sheets

SHOOTING TARGET AND METHOD OF MAKING SAME

FIELD OF THE INVENTION

This invention relates to shooting targets, and more particularly to a shooting target having a feature for enhancing the visibility of the point of impact, and for producing a more dramatic result when a projectile strikes the target, thereby enhancing the target shooting experience.

BACKGROUND OF THE INVENTION

In target shooting using a firearm, especially where the distance between the shooter and the target is large, e.g., 20 yards or more, it is difficult for the shooter to see the point at which his bullet punctures the target. At these longer distances, in order to see the points of impact on an ordinary target, the shooter must use a spotting telescope, approach the target, or utilize a target-moving apparatus to move the target toward the firing line for inspection.

Another way to make the point of impact visible is to incorporate into the target a coloring material that is dispersed by impact, enhancing the visibility of the point of impact. A "self-marking" target, utilizing a coloring material for this purpose is described in U.S. Pat. No. 3,330,561, granted Jul. 11, 1967. In the system described in U.S. Pat. No. 3,330,561, an array of receptacles, each containing a colored solid or liquid material is disposed behind a porous target sheet having a protective layer on its back surface. When the porous target sheet is struck by a bullet, the colored material in the receptacle behind the point of impact is released through the bullet hole formed in the target sheet and the protective layer, and absorbed by the target sheet in the vicinity of the point of impact, making the point of impact immediately visible to the shooter. In an alternative embodiment, instead of using a colored material, the receptacles contain a reactant liquid that combines chemically with a substance previously absorbed in the pores of the target sheet, producing a visible color change in the vicinity of the point of impact.

A problem with the target described in U.S. Pat. No. 3,330,561 is that size of the array of receptacles for coloring material or reactant is the same as the size of the target. Large amounts of coloring material or reactant are never used, especially if the shooter is sufficiently skilled to shoot in a tight pattern.

SUMMARY OF THE INVENTION

This invention addresses the aforementioned problem by enabling a shooter to customize a target easily, by arranging liquid-containing pockets behind a target sheet, and to limit the locations of those pockets to selected areas corresponding to predetermined areas of graphics printed on the front of the target sheet.

A shooting target in accordance with the invention comprises a target sheet having front and back faces, and a liquid-containing unit comprising plurality of connected, liquid-containing, blisters adhered to the back face of the target sheet. The liquid contained in each of the blisters is isolated from the liquid contained in each of the other blisters of the liquid-containing unit.

The liquid-containing unit comprising a plurality of blisters is formed by superimposing first and second sheets on each other, and adhering the sheets to each other along a continuous closed stripe defining an outline of the plurality of blisters, and along plural stripes each extending from one part of the continuous closed line to another part of the continuous closed stripe. The continuous closed stripe and the plural stripes define the boundaries of the blisters.

The back face of the target sheet is ordinarily substantially flat, and in that case, a first sheet of the liquid-containing unit is also preferably substantially flat and in surface to surface contact with the back face of the target sheet. The blisters are formed by bulbous portions of the second sheet and portions of the first sheet opposite the bulbous portions. The liquid contained in the blisters can be a dye the color of which should be visually distinguishable from the color of the majority of the area of the part of the target image in front of the liquid-containing unit.

A blister-containing unit having a desired shape can be removed from a larger array of liquid-containing blisters. For example, if each of the plural stripes that define boundaries of the blisters is provided with a row of perforations along its length, a multiple blister unit removed from the larger array can be composed of a non-rectangular array of rows and columns of blisters. In that case, the number of blisters in at least one of the rows will be different from the number of blisters in at least one other one of the rows.

The target sheet can have an image imprinted on its front face defined by a printed outline. The multiple blister, liquid-containing unit having a shape corresponding to the shape of the printed outline can then be removed from a larger array and adhered to the back face of the target sheet and positioned within an area on the back face of the target sheet defined by an outline, either printed or imaginary, directly opposite the outline defining the area of the image on the front face. The liquid-containing unit can substantially fill the defined area on the back face of the target sheet. The image on the front face of the target can be of any desired size and shape. The shooter can customize the target by selecting or producing a desired target image, and attaching a liquid-containing unit having a desired size and shape to the back face.

Another aspect of the invention is a method of making a shooting target. The method comprises the steps of separating a liquid containing unit, having rows and columns of liquid-containing blisters, from an array of connected, liquid-containing blisters arranged in rows and columns and in which the liquid contained in each of the blisters is isolated from the liquid contained in each of the other blisters of the array. The separated liquid-containing unit is adhered to the back face of a target sheet having a front and a back face, and a target image drawn or printed on its front face.

The target produced by the method can have any one of, or various combinations of, the several features mentioned above.

DETAILED DESCRIPTION

Figure 1:
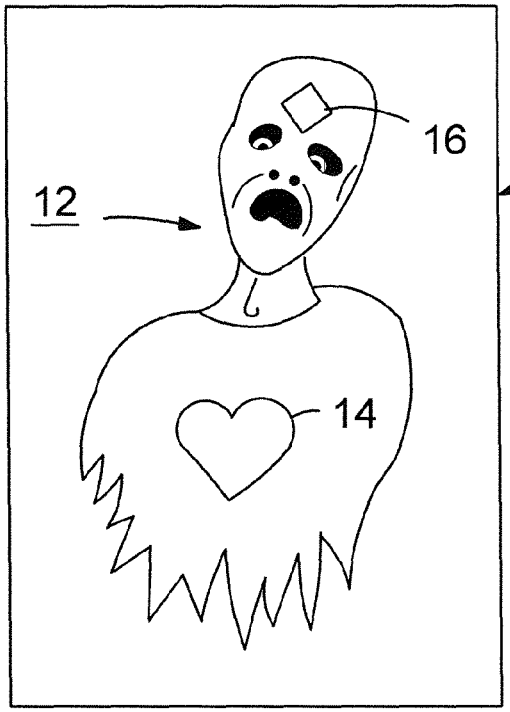
FIG. 1 is an elevational view of the front face of a target sheet for use in a shooting target according to the invention.

FIG. 1 shows a typical target sheet 10 having an image 12 drawn or printed on its front face. In this case, the image is that of a "zombie", with a heart-shaped area 14 outlined on its chest, and a diamond-shaped area 16 outlined on its forehead.

The target sheet can be a relatively stiff card stock or a more flexible sheet of paper. A target sheet composed of stiff card stock can be mounted easily by leaning it against an upright support, with its lower edge in contact with a horizontal surface. A flexible paper target sheet can be tacked or stapled to a backing frame. The frame should be an open frame composed of elements that lie behind margin areas of the target sheet. Alternative materials other than card stock and paper, such as fabrics or plastics can, of course, be used.

Figure 2:
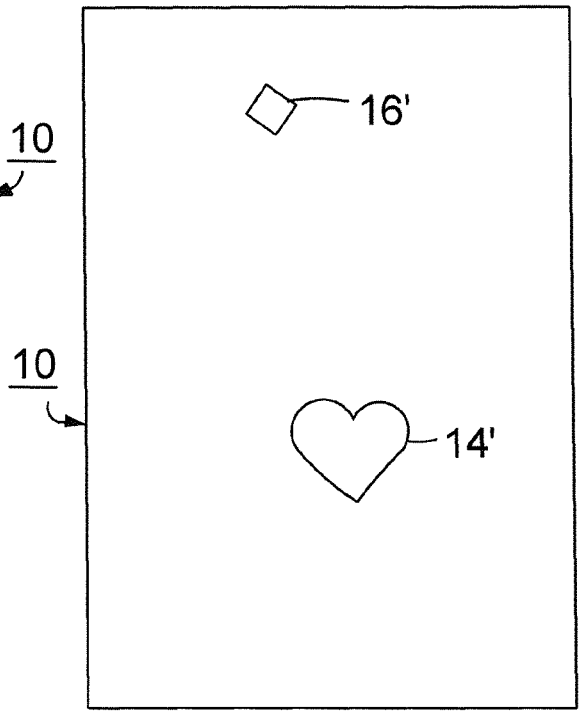
FIG. 2 is an elevational view of the back face of the target sheet.

Outlines 14' and 16', of the heart and the diamond-shaped area 14 and 16 may be printed on the back face of the target sheet 10 as shown in FIG. 2. Outlines 14' and 16' are provided to facilitate placement of multiple blister units, and define areas directly behind the corresponding heart and diamond-shaped areas on the front face of the target sheet. Alternatively, the printed outlines on the back face of the target sheet can be omitted, and the multiple blister units can be secured to the back face of the target sheet within areas defined by imaginary outlines directly opposite to the outlines drawn or printed on the front face.

As will be apparent, the target sheet can be supplied pre-printed by its manufacturer on its front face, or on both its front face and its back face, and the user can affix suitably shaped multiple-blister units to the back face of the target sheet. Alternatively, the user can generate his own target image, for example by drawing an image on, or attaching an image to, the front face of a blank target sheet. The user can then affix multiple-blister units to the back face of the sheet at locations that he or she determines.

Figure 3:
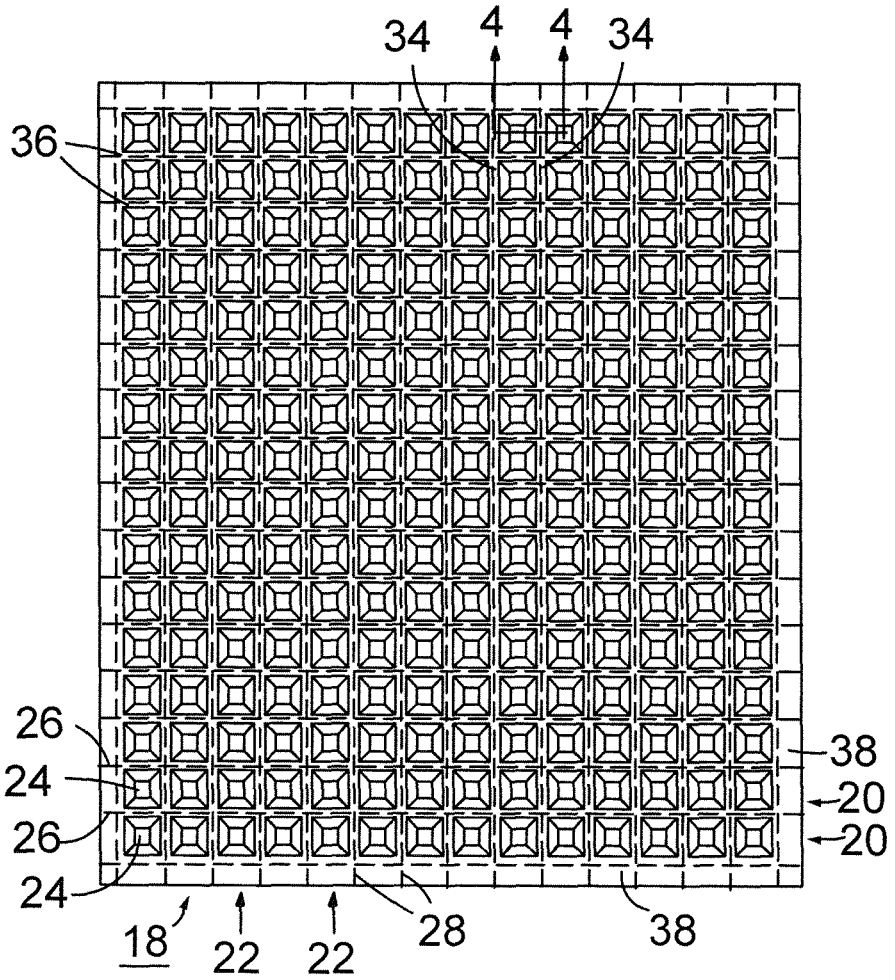
FIG. 3 is an elevational view of an array of liquid-containing blisters from which a multiple blister unit of a desired size and shape can be removed for attachment to the back face of the target sheet.

As shown in FIG. 3, the multiple blister units can be separated by the user from a rectangular array 18 of connected rows 20 and columns 22 of blisters 24. Lines 26 and 28 of perforations extend between adjacent rows and between adjacent columns of blisters to facilitate removal of multiple blister units in any desired shape.

Figure 4:
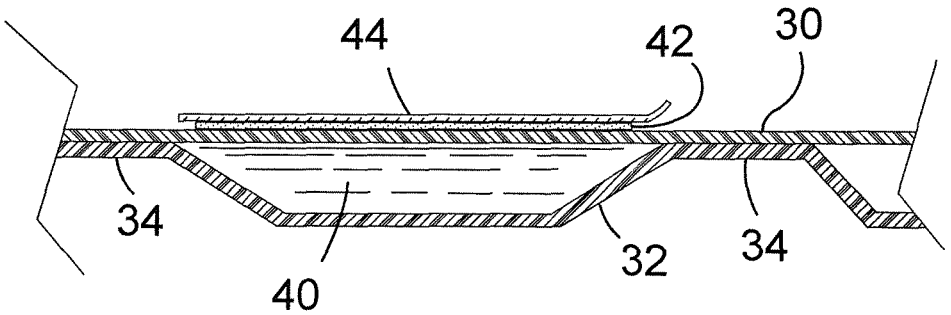
FIG. 4 is a fragmentary sectional view through a part of the blister array, taken on section plane 4-4 in FIG. 3.

As shown in FIG. 4, the blister array comprises a flat sheet 30, and sheet 32 in which the blisters 24 are formed. The two sheets 30 and 32 are adhered together along elongated stripes 34 and 36 (FIG. 3) that extend between the adjacent rows and columns of blisters, and along a rectangular border stripe 38 (FIG. 3). The sheets can be sealed together by any of various means such as heat sealing, sonic welding, or an adhesive. The blisters in sheet 32 are filled with a liquid dye 40 before sheet 30 is set in place and secured in overlying relationship with sheet 32.

As shown in FIG. 4, an area 42 of pressure-sensitive adhesive is provided on the outside face of sheet 30 opposite each blister, and covered by a peelable protective film 44. The pressure-sensitive adhesive is used to secure the multiple-blister units to the back face of the target sheet.

Figure 5:
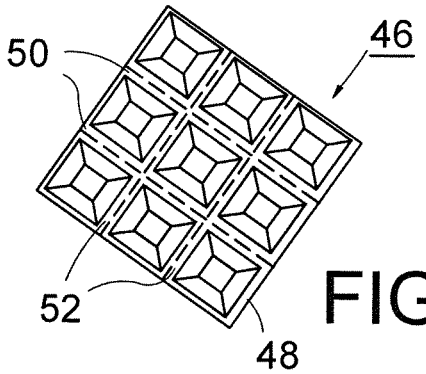
FIG. 5 is an elevational view of a diamond-shaped multiple-blister unit for use with the target sheet of FIGS. 1 and 2.

FIG. 5 shows a diamond-shaped multiple blister unit 46 composed of three rows of blisters, each row consisting of three blisters. The sheets (sheets 30 and 32 in FIG. 4) of the diamond-shaped blister unit are sealed together along a continuous, closed, rectangular border stripe 48, along a first pair of parallel stripes 50 extending across the unit from one part of the border stripe 48 to an opposite part thereof, and along a second pair of parallel stripes 52 extending across the unit from one part of the border stripe to an opposite part thereof. Stripes 52 extend in a direction perpendicular to the direction in which stripes 50 extend. This diamond-shaped multiple blister unit can be affixed to the back face of the target sheet 10 substantially within the area defined by printed outline 16' or substantially within an imaginary diamond-shaped outline directly behind outline 16 on the front face of the target sheet. The relationship between the multiple-blister units and the outlines on the front of the target does not need to be exact. A part of the outline on the target sheet can be somewhat outside or somewhat inside the border of the multiple blister unit. The term "substantially within the area" is intended to encompass a relationship between the outline on the target sheet and the border of the multiple blister unit such that the smallest distance between any point on the outline and the border of the multiple blister unit does not exceed the greater of the distances between corresponding parts of adjacent blisters in the row-wise and column-wise directions respectively. (Ordinarily, in an array of rectangular blisters, the row-wise and column-wise distances will be the same.)

Figure 6:
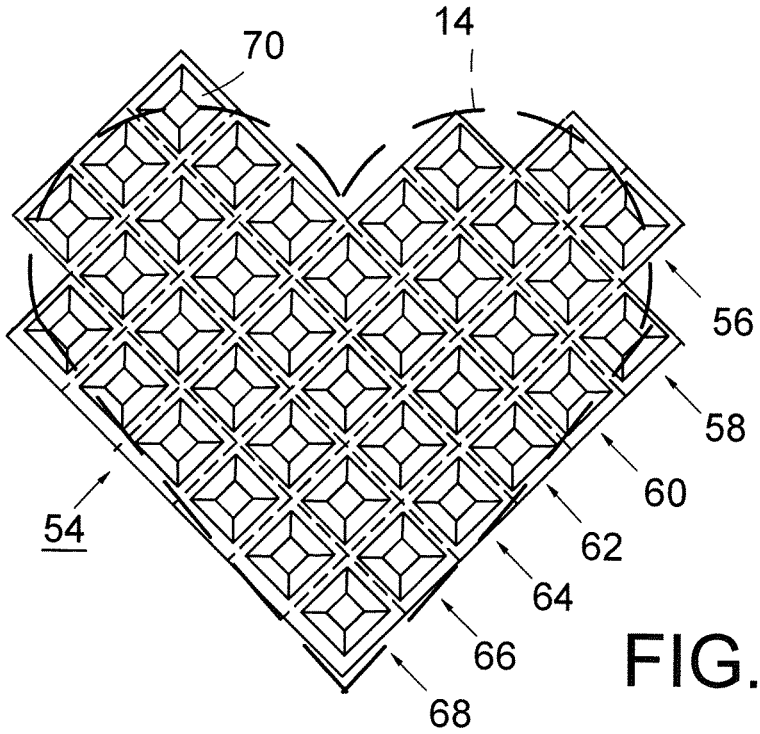
FIG. 6 is an elevational view of a heart-shaped multiple blister unit for use with the target sheet of FIGS. 1 and 2.

FIG. 6 shows a non-rectangular multiple blister unit 54 that approximates the heart-shaped outline 14 in FIG. 1. Multiple blister unit 54 is composed of seven rows of blisters, a first row 56 consisting of two blisters, second and third rows 58, each consisting of four blisters, fourth, fifth and sixth rows 60 each consisting of seven blisters, and a seventh row 62 consisting of six blisters. The heart outline 14 is shown as a broken line 14 in FIG. 6. Here, the multiple blister unit 56 is substantially within the area defined by an outline (14 in FIG. 2) corresponding to the outline 14. Note that the multiple blister sheet in FIG. 6 is asymmetrical. It could be made symmetrical by the removal of blister 70.

The target shooter can customize his or her targets by separating an appropriately shaped multiple blister unit from an array shown in FIG. 3, peeling off the adhesive-protecting films 44 behind the blisters, and securing the unit to the back face of the target at a position behind a designated area of the target, preferably an area defined by an outline on the front face of the target sheet.

When the target is struck by a bullet or other projectile at a location in front of a multiple-blister unit, rupture of a blister will release dye, and generate a pressure that causes a portion of the dye to flow outward through the hole in the target sheet, forming a spot that enhances the visibility of the point of impact so that it can be seen easily by the shooter, even at a distance far exceeding 20 yards. The release of the dye on impact also produces a dramatic effect, enhancing the target shooting experience.

Many of the advantages of the invention can be realized in alternative embodiments. Whereas a dye can be utilized in the blisters to enhance visibility of the points of impact, a chemical reaction between a liquid in the blisters and a substance absorbed into the target can produce a visible color change. For example, a solution of ferric chloride in the blisters will produce a bright red color upon reaction with potassium thiocyanate absorbed in the material of the target sheet.

Although the blister array is preferably formed from two sheets, one sheet (30 in FIG. 4) being flat so that it fits closely against the back face of the target sheet, in an alternative embodiment the blisters of the blister array can bulge in both directions, i.e., toward the front and back. In this case, attachment to the back face of the target is somewhat more difficult, but can still be accomplished if a suitable adhesive is used.

In each embodiment, blisters remaining in the blister array after removal of a multiple blister unit can be utilize to make other multiple blister units of various shapes and sizes. Individual blisters, or small groups of blisters that remain after removal of multiple blister units can be combined and secured to the back faces of other target sheets even though not held together as unit. Therefore, waste of dye-containing blisters can be avoided.

What is claimed is:

1. A method of making a shooting target comprising the steps of:

erecting a target sheet having a front and a back face, and a target image on said front face, said target image covering, and being limited to, an area defined by a visible outline;

separating a liquid containing unit from an array of connected, liquid-containing blisters arranged in rows and columns, in which the liquid contained in each of said blisters is isolated from the liquid contained in each of the other blisters, said liquid-containing unit having rows and columns of liquid-containing blisters; and adhering said separated liquid-containing unit to the back face of said target sheet;

the shape of said separated liquid-containing unit being such that, when adhered to the back face of the target sheet, said separated liquid containing unit is positioned substantially within, and substantially fills, an area on the back face of the target sheet defined by an outline directly opposite said outline defining the area of said image;

in which the back face of said target sheet is substantially flat, and said plurality of blisters is formed by first and second sheets of uniform thickness superimposed on each other and adhered directly to each other along a continuous closed stripe defining an outline of said plurality of blisters and along plural stripes each extending from one part of said continuous closed stripe to another part of said continuous closed stripe, said continuous closed stripe and said plural stripes define the boundaries of said blisters, said first sheet is flat and in surface to surface contact with the back face of said target sheet, and said blisters are formed by bulbous portions of said second sheet and portions of said first sheet opposite said bulbous portions.

2. The method according to claim 1, in which the step of separating said liquid containing unit from said array of connected, liquid-containing blisters is carried out by dividing at least one of said plural stripes along a line extending lengthwise of said one of said plural stripes and located at an intermediate location between blisters on opposite sides of said one of said plural stripes.

3. The method according to claim 1, in which the step of separating said liquid containing unit from said array of connected, liquid-containing blisters is carried out by dividing at least one of said plural stripes along a line of perforations extending lengthwise of said one of said plural stripes and located at an intermediate location between blisters on opposite sides of said one of said plural stripes.

* * * * *